US008438810B2

(12) United States Patent
Robbins et al.

(10) Patent No.: US 8,438,810 B2
(45) Date of Patent: May 14, 2013

(54) WEB OR VAPOR RETARDER WITH TIE-STRAP

(75) Inventors: Hal J. Robbins, Langhorne, PA (US); John A. Post, Tranquility, NJ (US)

(73) Assignee: Lamtec Corporation, Mount Bethel, PA (US)

( * ) Notice: Subject to any disclaimer, the term of this patent is extended or adjusted under 35 U.S.C. 154(b) by 252 days.

(21) Appl. No.: 12/511,645

(22) Filed: Jul. 29, 2009

(65) Prior Publication Data

US 2010/0024325 A1 Feb. 4, 2010

Related U.S. Application Data

(60) Provisional application No. 61/084,397, filed on Jul. 29, 2008.

(51) Int. Cl.
*E04B 1/74* (2006.01)

(52) U.S. Cl.
USPC ..... 52/407.3; 52/407.1; 52/407.4; 52/506.01

(58) Field of Classification Search ..... 52/508, 52/404.1, 407.1, 407.3, 407.4, 408, 63, 749.12, 52/566, 3, 222, 506.01
See application file for complete search history.

(56) References Cited

U.S. PATENT DOCUMENTS 2,320,852 A * 6/1943 De Falco ..... 160/84.04
3,300,926 A * 1/1967 Heirich ..... 52/300
3,619,437 A * 11/1971 McDonald, Jr. ..... 264/46.6
4,172,345 A * 10/1979 Alderman ..... 52/406.2
4,544,011 A * 10/1985 Sawamura ..... 160/84.04
4,590,714 A * 5/1986 Walker ..... 250/585
4,590,727 A * 5/1986 Ghahremani et al. ..... 52/406.3
4,704,312 A * 11/1987 Butcher ..... 428/12
5,119,612 A * 6/1992 Taylor et al. ..... 52/410
5,184,659 A * 2/1993 Alcocer ..... 160/84.04
5,205,334 A * 4/1993 Judkins ..... 160/89
5,251,415 A * 10/1993 Van Auken et al. ..... 52/407.4
5,503,210 A * 4/1996 Colson et al. ..... 160/84.05
5,513,470 A * 5/1996 Vollebregt ..... 52/13
5,561,959 A * 10/1996 Alderman et al. ..... 52/407.3
5,690,156 A * 11/1997 Ruggles ..... 160/84.04
5,724,780 A * 3/1998 Bolich ..... 52/407.4
5,809,701 A * 9/1998 Vollebregt ..... 52/13
5,918,436 A * 7/1999 Alderman ..... 52/407.3
5,921,057 A * 7/1999 Alderman et al. ..... 52/746.11
6,199,337 B1 * 3/2001 Colson et al. ..... 52/506.06
6,363,684 B1 * 4/2002 Alderman et al. ..... 52/742.12
6,393,797 B1 * 5/2002 Romes ..... 52/746.1
6,401,426 B1 * 6/2002 Alderman et al. ..... 52/749.12
6,421,980 B1 * 7/2002 Alderman et al. ..... 52/746.11

(Continued)

*Primary Examiner* — Robert Canfield
*Assistant Examiner* — Brent W Herring
(74) *Attorney, Agent, or Firm* — Fay Sharpe LLP

(57) ABSTRACT

A vapor retarder system includes a vapor retarder sheet. At least one and typically a plurality of parallel spaced-apart tie-straps are located adjacent an inner surface of the sheet, and the tie-strap extend across a width of the sheet and are connected to the sheet at multiple connection locations that are spaced from each other along a length of the tie strap. The sheet includes drape regions where the sheet is disconnected from the tie straps between successive connection locations. The tie-straps and drape regions ensure that the vapor retarder sheet is installed over roof purlins with the proper drape between the purlins to obtain the required insulation R-values. A fall-protection net or sheet can also be constructed and/or installed in the same manner.

10 Claims, 6 Drawing Sheets

U.S. PATENT DOCUMENTS 6,427,409 B2 * 8/2002 Colson et al. ..... 52/506.08
6,694,693 B2 * 2/2004 Alderman ..... 52/478
6,857,238 B2 * 2/2005 Alderman ..... 52/407.3
2003/0167718 A1 * 9/2003 Alderman ..... 52/407.3

* cited by examiner

WEB OR VAPOR RETARDER WITH TIE-STRAP

CROSS-REFERENCE TO RELATED APPLICATION

This application claims priority from and benefit of the filing date of U.S. provisional patent application Ser. No. 61/084,397 filed Jul. 29, 2008, and the entire disclosure of said provisional application Ser. No. 61/084,397 is hereby expressly incorporated by reference into the present specification.

BACKGROUND

FIG. 1 illustrates a known (prior art) building roof structure R comprising a corrugated metal or other roof deck D supported on plurality of parallel, spaced-apart purlins, trusses or other structural members P that extend axially along respective longitudinal axes PX that each extend perpendicularly into and out of the page as shown in FIG. 1. Between each successive pair of purlins P, an open bay B is defined, and the roof deck D spans the bays B. It is known to insulate the roof deck D with a known roof insulation system 10. Typically, as shown in FIG. 1, the known roof insulation system 10 comprises a vapor retarder facing or web or sheet S draped over the respective upper flanges or edges P1 of multiple (at least two) successive purlins P so that the sheet S spans one or more bays B. The vapor retarder sheet S may be fixed to at least some or all of the purlins P over which it is draped using suitable fasteners, adhesive or other means (the vapor retarder sheet S is usually secured to the first and last purlins P over which it is draped). The vapor retarder sheet S is a single layer or multiple layer product, e.g., single-layer vinyl film/sheet or other film/sheet, or a laminated composite containing various combinations of aluminum foil, polymeric film/sheet, kraft paper, reinforcing yarns and fabrics. Vapor retarder sheets S vary in strength, color, light reflectivity, and their ability to retard moisture migration therethrough. An insulation space SP is thus defined between the inner face S1 of the sheet S and the roof deck D (i.e., the sheet inner face S1 is oriented toward the roof deck D), and fiber glass or other insulation I is laid or blown or otherwise installed in the insulation space SP and is supported on the inner face S1 of the vapor retarder sheet S and/or laminated to the inner face S1 vapor retarder sheet S. As noted, the vapor retarder sheet S inhibits migration of moisture into the insulation and improves aesthetics of the interior of the building.

FIG. 2 is identical to FIG. 1, except that a drawback of the system 10 of FIG. 1 is illustrated. In particular, during installation or of the vapor retarder sheet S, the sheet can be pulled too tightly (over-tensioned) across one or more bays B, in a direction transverse to the purlin longitudinal axes PX, so that the height (relative to the roof deck D) and volume of the insulation space SP is diminished, leading to a reduction in the available space for insulation I and/or leading to undesired compression of any previously installed insulation I, both of which reduce the efficiency or "R-value" of the insulation I. Another, related deficiency of the known roof insulation system 10 is that the vapor retarder sheet S might not pulled tight enough (under-tensioned) across one or more bays B, which leads to a sagging appearance and/or can cause the insulation I to move away from the purlins P toward the middle of the bay B, leaving the lateral areas of each bay B adjacent the purlins P under-insulated.

SUMMARY

In accordance with one aspect of the present development, a vapor retarder system includes a vapor retarder sheet. At least one tie-strap is located adjacent an inner surface of the sheet, and the tie-strap extends across a width of the sheet and is connected to the sheet at multiple connection locations that are spaced from each other along a length of the tie-strap. The sheet includes drape regions where the sheet is disconnected from the tie-strap between successive connection locations.

In accordance with another aspect of the present development, a roof structure includes a plurality of parallel, spaced-apart purlins, wherein bays are defined between each successive pair of the purlins. The roof structure further includes a vapor retarder system including a vapor retarder sheet draped over a plurality of the purlins so as to span multiple bays. The vapor retarder sheet includes a tie-strap located adjacent an inner surface of the sheet. The tie-strap is connected to the sheet at multiple connection locations that are spaced from each other along a length of the tie-strap. The sheet includes drape regions that are disconnected from the tie-strap between successive connection locations. The tie-strap is extended so that the connection locations are located adjacent respective ones of the purlins and the drape regions are located in respective bays between successive ones of said purlins.

DETAILED DESCRIPTION

Figure 2:
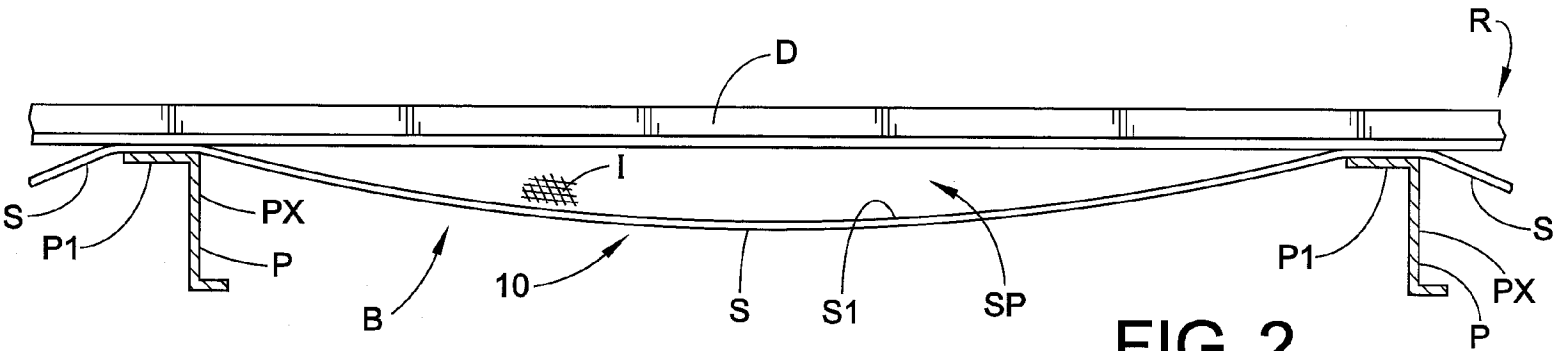
FIG. 2 (PRIOR ART)
FIG. 2 (prior art) shows the insulated rood structure of FIG. 1 and a common defect with respect to the installation of the vapor retarder sheet and insulation.
Figure 3:
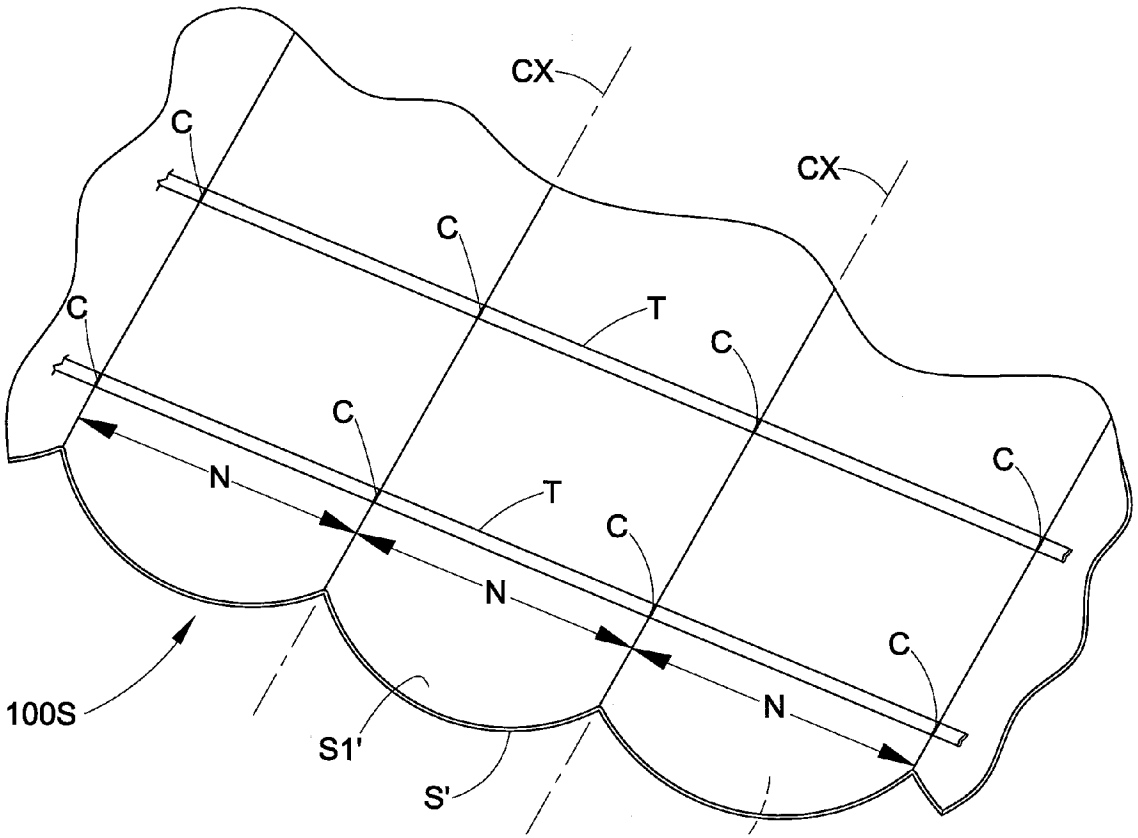
FIG. 3 is an isometric view of a vapor retarder sheet system formed in accordance with the present development.
Figure 4:
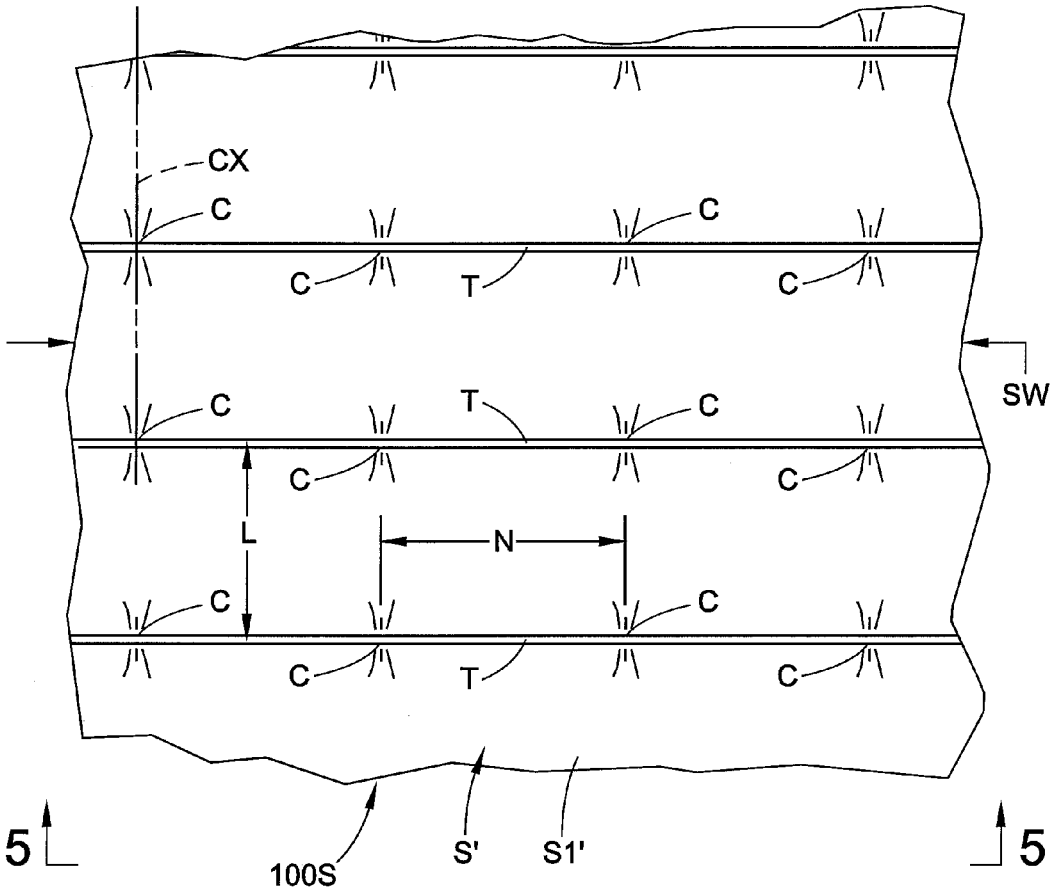
FIG. 4 is a top view of the vapor retarder sheet system FIG. 3.
Figure 5:
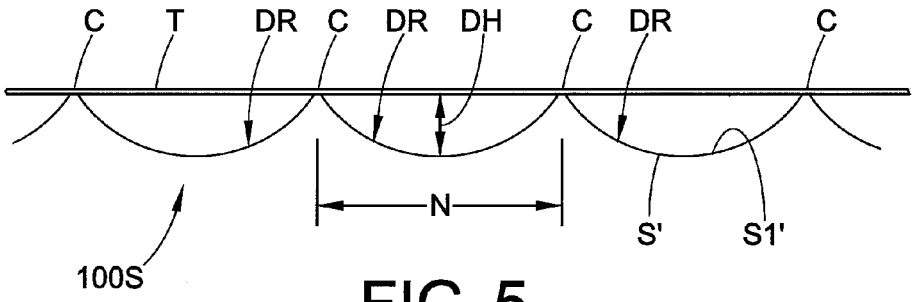
FIG. 5 is a side view as taken along view line 5-5 of FIG. 4.

FIG. 3 is an isometric view of a vapor retarder sheet assembly or system 100S formed in accordance with the present development. FIG. 4 is a top view of the vapor retarder sheet system 100S of FIG. 3, and FIG. 5 is a side view as taken along view line 5-5 of FIG. 4. Referring to all of FIGS. 3-5, the vapor retarder sheet system 100S comprises a vapor retarder facing or web or sheet S', that is identical to the conventional vapor retarder facing or web or sheet S disclosed above in connection with FIGS. 1 and 2, and further comprises at least one and preferably a plurality of tie-straps T that extend coextensive or at least substantially coextensive with a width SW of the sheet S' which can vary, but is at least equal to the lateral spacing between two successive purlins P. The tie-straps T comprise or are defined from any suitable flexible fabric, cloth, yarn, film, web, strap or other flexible member that is connected to the vapor retarder sheet S' at multiple connection locations C spaced along the length or longitudinal axis of each tie-strap T so that the tie-strap T lies adjacent the inner surface S1'. Preferably, multiple (at least two) tie-straps T are connected to the vapor retarder sheet and lie adjacent inner surface S1' and are arranged in parallel (i.e., at least substantially parallel) spaced-apart relation to each other, spaced from each other at an interval L. The lateral spacing interval L can vary within a sheet system 100S and can vary as between different sheet systems 100S.

Each tie-strap T is connected to the inner surface S1' and/or other part of the sheet S' at the connection locations C that are spaced from each other at a constant interval N along the length or longitudinal axis of each tie-strap T. Furthermore, each tie-strap T is connected in the same manner and at the same constant interval N so that the respective corresponding connection points C of the straps T are aligned with each other on respective strap-connection axes CX that extend transverse to the longitudinal axes of each tie-strap T. Each tie-strap T is preferably continuous, but those of ordinary skill in the art will recognize that each tie-strap T can be replaced by multiple separate tie-straps, each having a length of at least one interval N.

The vapor retarder sheet system 100S can be rolled or folded as desired for storage and transport. When completely unfurled as shown in FIGS. 3-5, the tie-straps T are extended to a maximum extent, and the tie-straps T limit maximum extension of the vapor retarder sheet S' to the width SW, which is less than a full unrestricted width of the sheet S' if it was not connected to the one or more tie-straps T. Between successive connection points C, the vapor retarder sheet S' defines a drape region DR (FIG. 5) that is free of and not connected to the tie-strap(s) T so that it has a predetermined, select drape height DH (measured as the maximum possible distance between the plane of the fully extended tie-strap T and the inner surface S1') which is predetermined when the tie-strap(s) T are connected to the sheet S'. The drape height DH is controlled by the extent to which the length/width of the sheet S' between any two successive connection points C is greater than the straight-line spacing interval N between the same two successive connection points C, i.e., the distance between the two successive connection points C is shorter by a first path that follows said tie-strap T as compared to a second path that follows said sheet S'. In one embodiment, the spacing interval N between connection points C is in the range of 24 inches to 72 inches (commonly 60 inches) and the drape height is in the range of 3 inches to 18 inches, but the present development is not limited to such dimensions.

Figure 1:
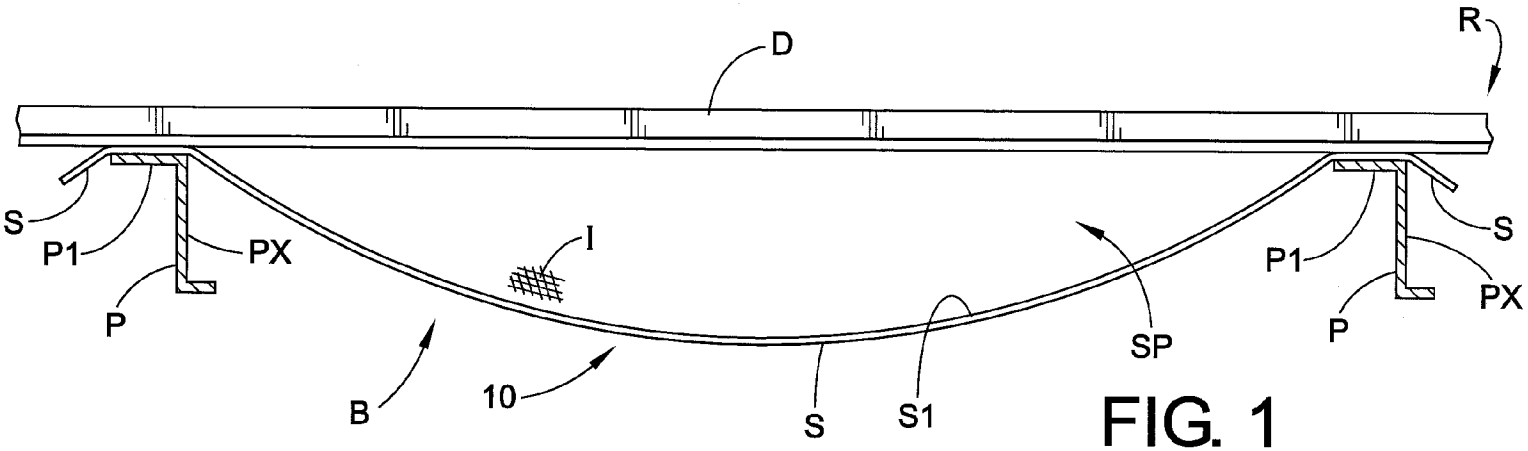
FIG. 1 (PRIOR ART)
FIG. 1 (prior art) illustrates a known building roof structure insulated using a conventional vapor retarder sheet.
Figure 6:
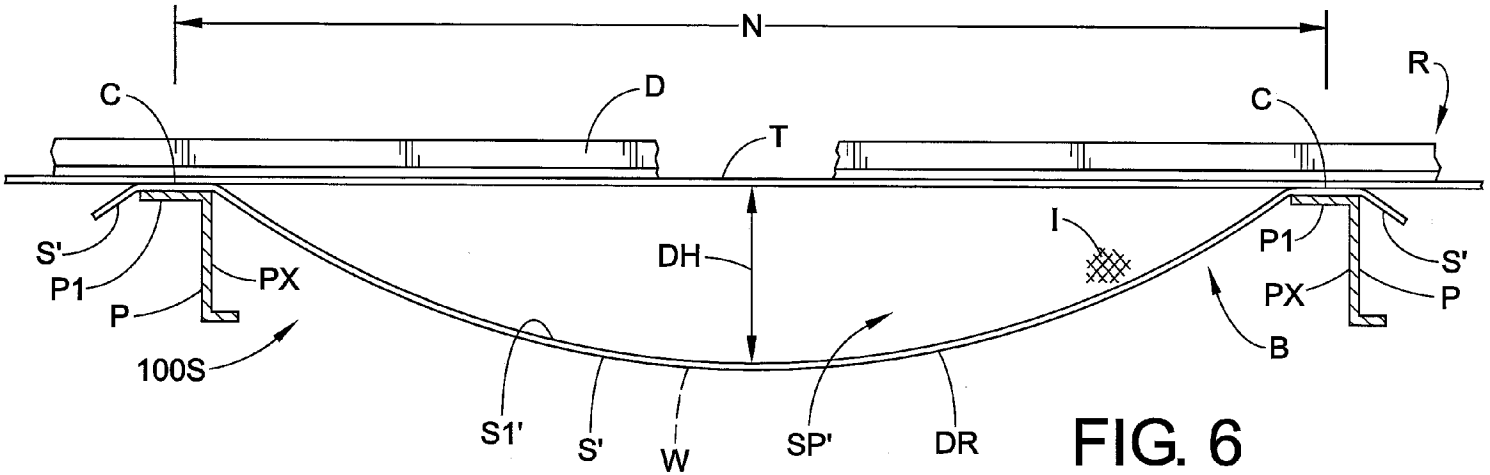
FIG. 6 illustrates the known building roof structure of FIGS. 1 and 2, with a portion of the roof deck broken away, and shows a roof insulation system formed in accordance with the present development using the vapor retarder sheet system of FIG. 3.

FIG. 6 illustrates the known building roof structure R of FIGS. 1 and 2, which is not described again here, with portions of the roof deck D are broken away. FIG. 6 shows a roof insulation system 100 formed in accordance with the present development using the vapor retarder sheet system 100S. The vapor retarder sheet S' is draped over the upper flange or edge P1 of multiple (at least two) successive purlins P so that the sheet S' spans one or more bays B, with the tie-straps T extending perpendicularly or otherwise transversely between the purlins P. The connection point interval N of the tie-straps T to the sheet S' is selected to match the lateral spacing between successive purlins P (preferably at the centers of the upper edges/flanges P1) so that the connection points C are located on or at least near the purlin upper flanges/edges P1, with the strap connection axes CX extending parallel with the purlin longitudinal axes PX.

Those of ordinary skill in the art will recognize that the presence of the tie-straps T ensures that the vapor retarder sheet S' is arranged in each bay B with the drape regions DR suspended or "pillowed" in the bays B and exhibiting the select, predetermined drape height DH when the tie-straps T are fully extended. The tie-straps T prevent over-tensioning of the vapor retarder sheet S' between successive purlins P as described above in relation to FIG. 2. As such, the vapor retarder sheet S' allows for consistently higher R-values as compared to prior systems. The vapor retarder sheet S' may be fixed to some or all of the purlins P over which it is draped using suitable fasteners, adhesive or other means, after which the tie-straps T can be severed if desired, e.g., into tie-strap sections Ta,Tb as shown in broken lines, to facilitate installation of fiber glass or other insulation I in the insulation space SP' defined between the inner surface S1' of the vapor retarder sheet S' and the roof deck D, or the tie-straps T can be left intact. In one example, the vapor retarder sheet S' is connected to the first and last purlins P over which it is draped.

The vapor retarder sheet S' is a single layer or multiple layer product, e.g., single-layer vinyl film/sheet or other film/sheet, or a laminated composite containing various combinations of aluminum foil, polymeric film/sheet, kraft paper, reinforcing yarns and fabrics. The retarder sheet S' can vary in strength, color, light reflectivity, ability to retard moisture migration therethrough, and other attributes without departing from the overall scope and intent of the present development.

Figure 7:
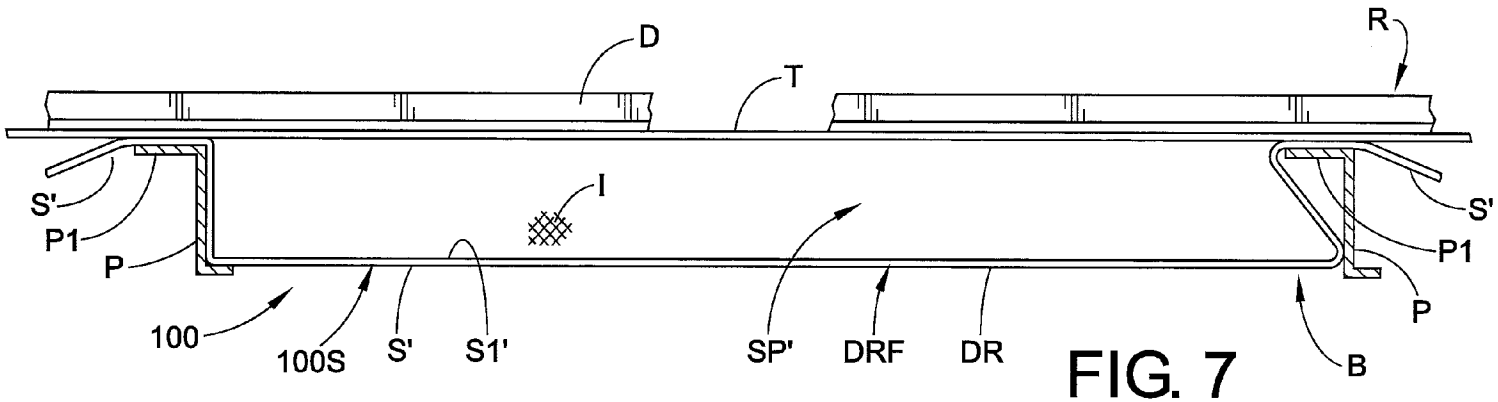
FIG. 7 is similar to FIG. 6 but shows that the vapor retarder sheet of the present development can alternatively be affixed to the purlins of the roof structure.

As shown in FIG. 7, in an alternative embodiment, the drape region DR of the sheet S' can be affixed to the purlins P so that the drape region DR is pulled tight between the purlins or otherwise shaped as desired, e.g., with a substantially planar outer face DRF that lies at least substantially parallel to the fully extended tie-strap T as shown in FIG. 7. In such case, the drape height DH (FIG. 6) of the sheet S' must be dimensioned properly to ensure that sufficient material of the sheet S' is present in the bay B to allow the drape region DR to be shaped as desired/required.

Figure 8:
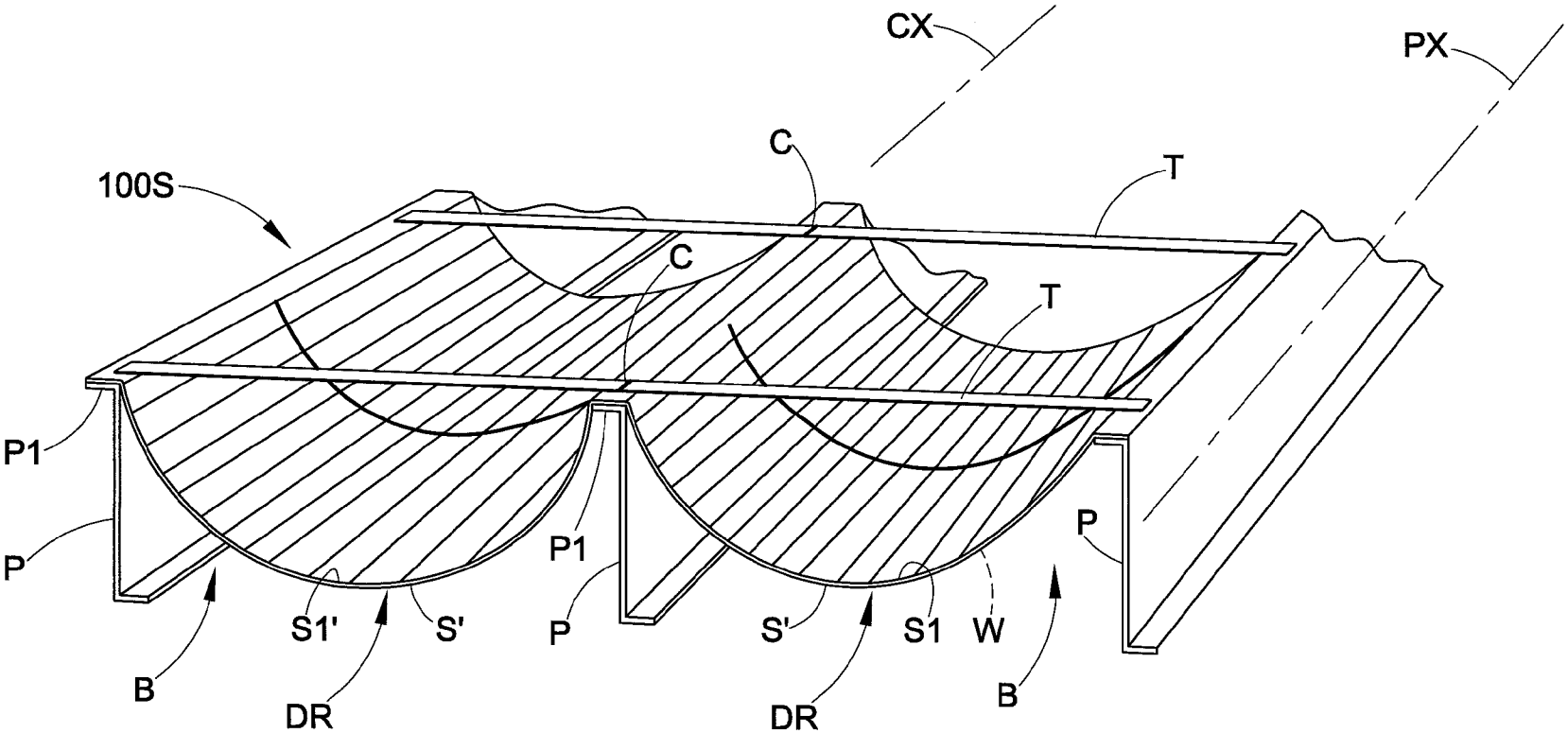
FIG. 8 is an isometric view of the installed vapor retarder sheet system of the present development that is similar to FIG. 6, but not showing the roof deck or any installed insulation.

FIG. 8 is an isometric view of the installed vapor retarder sheet system 100S of the present development that is similar to FIG. 6, but not showing the roof deck D or any installed insulation 1.

In an alternative embodiment, the vapor retarder sheet S' is replaced with an alternative sheet or web that can be any desired polymeric sheet/film, fabric, cloth, netting, laminate and/or other flexible material. In one such embodiment, as shown at W in FIGS. 3, 6, and 8 using a broken lead line, such an alternative web W is provided as a fall-protection member that will support a person or object that falls from the purlins P or other location above the web W. One suitable fall protection member is defined from or comprises a netting material.

Figure 9:
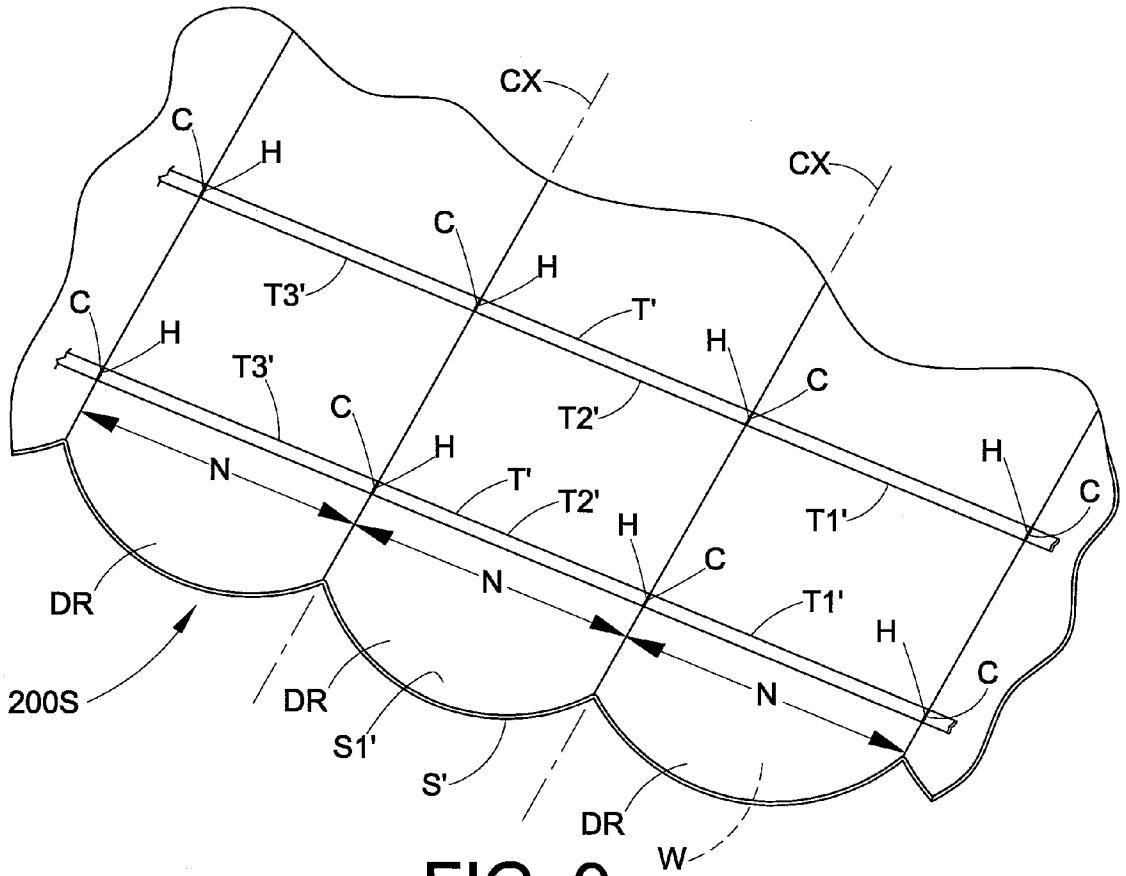
FIG. 9 is an isometric view of a vapor retarder sheet system formed in accordance with an alternative embodiment of the present development.

FIG. 9 is an isometric view of a vapor retarder sheet system 200S formed in accordance with the present development, which is identical to the system 100S excepts as shown and/or described herein. The system 200S differs from the system 100S in that the flexible tie-straps T are replaced by rigid or semi-rigid tie-members or tie-straps T' defined from wood, foam, polymeric members, corrugated cardboard or polymeric material or the like. In such case, the tie-straps T' are connected to the vapor retarder sheet S' (or fall protection web W) to lie adjacent the inner surface S1'. Each tie-member T' is connected to the inner surface S1' or other location of the sheet S' at the connection locations C that are spaced from each other at an interval N along the length or longitudinal axis of each tie-member T'. Each tie-member T' thus defines successive sections T1',T2',T3', etc. between the connection locations C. Furthermore, each tie-member T' is connected in the same manner and at the same interval N so that the respective connection points C of the tie-straps T' are aligned with each other on respective connection axes CX that extend transverse to the longitudinal axes of each tie-member T'. The tie-straps T' comprises a hinge H adjacent each connection point C, e.g., a living hinge defined by a weakened/flexible zone in the case where each tie-member T' is a continuous strip of material, or by a cut and/or break and/or space in the tie-member T', or by connecting successive sections T1',T2', T3', etc. of the tie-member T' with a separate hinge device which could be a flexible strip of fabric or other material. As described above for the system 100S, between successive connection points C along the axis of each tie-member T', the vapor retarder sheet S' defines a drape region DR that is free of or not connected to the tie-member T' so that it has a predetermined, select non-zero drape height DH (FIG. 5) which is predetermined when the tie-straps T' are connected to the sheet S'. The drape height DH is controlled by the extent to which the length of the sheet S' between successive connection points C is greater than the straight-line spacing interval N between the connection points C. A greater drape height DH will allow for greater amounts of insulation I to be installed in the insulation space SP'.

The development has been described with reference to preferred embodiments. Those of ordinary skill in the art will recognize that modifications and alterations to the preferred embodiments are possible. The disclosed preferred embodiments are not intended to limit the scope of the following claims, which are to be construed as broadly as possible, whether literally or according to the doctrine of equivalents.

The invention claimed is:

1. A roof structure comprising:

a plurality of parallel, spaced-apart purlins, wherein bays are defined between each successive pair of said purlins;

a vapor retarder system comprising:

a vapor retarder sheet draped over a plurality of said purlins so as to span multiple bays, said vapor retarder sheet comprising a tie-strap located adjacent an inner surface of said sheet, said tie-strap connected to said sheet at multiple connection locations that are spaced from each other along a length of the tie-strap, wherein the sheet comprises drape regions that are disconnected from the tie-strap between successive connection locations, said connection locations located adjacent respective ones of said purlins and said drape regions located in respective bays between successive ones of said purlins, wherein said tie-strap is severed between connection locations along the length of the tie-strap such that said tie-strap is interrupted in the region of a corresponding one of said bays;

a roof deck supported on said purlins, wherein said inner surface of said vapor retarder sheet is oriented toward said roof deck;

insulation located in each of said bays and supported on said inner surface of said vapor retarder sheet.

2. The roof structure as set forth in claim 1, wherein each drape region of said sheet defines a non-zero drape height between said successive connection locations, wherein said drape height is defined as a maximum distance measured between said inner surface of said sheet and a plane that includes said tie-strap when said tie-strap is fully extended between said successive connection points.

3. The roof structure as set forth in claim 2, wherein the drape height is in the range of 3 inches to 18 inches.

4. The roof structure as set forth in claim 2, comprising a plurality of said tie-straps arranged parallel and spaced-apart relative to each other.

5. The roof structure as set forth in claim 4, wherein said successive connection locations for each of said tie-straps are spaced from each other by a constant interval, and wherein said constant interval is the same for each of said plurality of tie-straps such that corresponding connection locations of the plurality of tie-straps define respective connection axes that extend parallel to and that are aligned with said purlins.

6. The roof structure as set forth in claim 5, wherein said tie-straps each comprise a flexible member, and wherein each of said connection locations comprises a sewn connection between said sheet and said tie-strap.

7. The roof structure as set forth in claim 5, wherein said tie-straps each comprise a rigid or semi-rigid member including hinges respectively located adjacent at least some of the connection points such that said tie-strap is able to be pivoted and folded upon itself at each of said hinges.

8. The roof structure as set forth in claim 1, wherein said vapor retarder sheet comprises a single layer or multiple layers of at least one of polymeric film, aluminum foil, kraft paper, reinforcing yarn, reinforcing fabric.

9. The roof structure as set forth in claim 1, wherein the drape regions respectively located in each bay are secured to both purlins that define the bay.

10. A vapor retarder sheet draped over a plurality of roof purlins so as to span multiple open bays defined between successive parallel spaced-apart ones of said roof purlins, said vapor retarder sheet comprising a tie-strap located adjacent an inner surface of said sheet, said tie-strap connected to said sheet at multiple connection locations that are spaced from each other along a length of the tie-strap, wherein the sheet comprises drape regions that are disconnected from the tie-strap between successive connection locations, said connection locations located adjacent respective ones of said purlins and said drape regions located in respective bays, wherein said tie-strap is severed between connection locations along the length of the tie-strap such that said tie-strap is interrupted in the region of a corresponding one of said bays.

* * * * *